United States Patent [19]

Sukonick et al.

[11] Patent Number: 4,533,910

[45] Date of Patent: Aug. 6, 1985

[54] GRAPHICS DISPLAY SYSTEM WITH VIEWPORTS OF ARBITRARY LOCATION AND CONTENT

[75] Inventors: Josef Sukonick, Cupertino; Bjorn M. Fjallstam, Sunnyvale, both of Calif.

[73] Assignee: Cadtrak Corporation, Sunnyvale, Calif.

[21] Appl. No.: 438,476

[22] Filed: Nov. 2, 1982

[51] Int. Cl.[3] ..... G09G 1/00

[52] U.S. Cl. ..... 340/721; 340/724; 340/798; 364/521

[58] Field of Search ..... 340/703, 721, 723, 724, 340/727, 747, 799, 798; 364/521

[56] References Cited

U.S. PATENT DOCUMENTS

| | | | |
|---|---|---|---|
| 3,792,462 | 2/1974 | Casey et al. . | |
| 4,168,488 | 9/1979 | Evans | 340/727 |
| 4,197,590 | 4/1980 | Sukonick et al. | 340/721 |
| 4,204,206 | 5/1980 | Bakula et al. | 340/721 |
| 4,258,361 | 3/1981 | Hydes et al. | 340/721 |
| 4,295,135 | 10/1981 | Sukonick | 340/721 |
| 4,414,628 | 11/1983 | Ahuja et al. | 340/721 |
| 4,437,093 | 3/1984 | Bradley | 340/724 |
| 4,442,495 | 4/1984 | Sukonick | 340/799 |

FOREIGN PATENT DOCUMENTS 2078411 1/1982 United Kingdom .

*Primary Examiner*—Gerald L. Brigance
*Attorney, Agent, or Firm*—Spensley Horn Jubas & Lubitz

[57] ABSTRACT

In this computer graphics display system, individual viewports of arbitary arrangement, number and content are produced on a video screen. The graphics content, display parameters and interviewport spacing all are specified by a set of control word sequences stored in a control table. Each sequence is associated with one scan line segment of an individual viewport, and consists of one or more control words that specify (a) the graphics image memory location of the pixel data to be included in that viewport segment, and (b) display parameters which specify how that pixel data is to be processed before supply to the video screen.

Control word display parameters and the associated graphics image (pixel) data are alternately obtained from a control/pixel memory and supplied to a first-in-first-out (FIFO) memory. At the outbound side of the FIFO memory, a controller enters the display parameters in appropriate registers. Pixel data then is serialized and processed in accordance with these display parameters, which may include color, zoom replication, and background grid insertion. After supplying the processed graphics data to the video screen, the controller supplies background control signals so as to produce an interviewport region on the video screen in accordance with the interviewport spacing specified by the control word sequences. Panning in any viewport is accomplished by altering the control word sequences associated with successive video frames so as to specify different sets of pixel data which, when reproduced in successive frames, give the illusion of image movement.

22 Claims, 9 Drawing Figures

FIG. 4

CONTROL WORD FORMAT

Control Word #1 Viewport Constants

```
B B B B B B B B B B B B B B B B B B B B B B B B B B B B B B B B B B B B B B B B B B B B B B B B B B B B B B B X X X X X X X X A A
F E D C B A 9 8 7 6 5 4 3 2 13Ø F E D C B A 9 8 7 6 5 4 3 2 12Ø F E D C B A 9 8 7 6 5 4 3 2 11Ø F E D C B A 9 8 7 6 5 4 3 2 1ØØ
[-INTERVIEWPORT COUNT---][-RFAC--][-----] [-GRID TYPE---][----GCBA------][---][-----SCREEN PIXEL COUNT------] [-PIXEL COLOR---]  Ø Ø
    (IVPC)                   BITS/PIXEL                                R BLANK                                  BASE ADDRESS
                                                                                                                (PCBA)
```

Control Word #2 Panning Parameters

```
                                                                                  ---LSB---
T T T T T T T T T T T T T T T T T T T T T T T T T B B B B B C B B B B B X B B B B B B B B B B T T T T T T T T X X B B B B T T
F E D C B A 9 8 7 6 5 4 3 2 13Ø F E D C B A 9 8 7 6 5 4 3 2 12Ø F E D C B A 9 8 7 6 5 4 3 2 11Ø F E D C B A 9 8 7 6 5 4 3 2 1ØØ
[----------------MEMORY PIXEL START ADDRESS-----------------] [GRID ][-]  [-- GRID SPACING---] [--WORDCOUNT--]    [-ROFF-] Ø[-]
                        (MPSA)                                  OFFSET
                                                                TOTAL BLANK                                        CONTINUATION BIT
                                                                LINE BIT                                           (STATUS BIT)
```

Control Word #3 Continuation Word(s)

```
T T T T T T T T T T T T T T T T T T T T T T T T T T T T X X X X X X X X X X X X X X X T T T T T T T T X X X X X T T
F E D C B A 9 8 7 6 5 4 3 2 13Ø F E D C B A 9 8 7 6 5 4 3 2 12Ø F E D C B A 9 8 7 6 5 4 3 2 11Ø F E D C B A 9 8 7 6 5 4 3 2 1ØØ
[---------------------MPSA---------------------] Ø Ø Ø Ø Ø Ø                                [--WORDCOUNT---]          Ø[-]
                                                                                                                CONTINUATION BIT
```

Control Word #4 New Table Address/End of Control Table

```
T T T T T T T T T T A A A A A A A A A A A A A A A A T T T T T T X X X X X X X X X X X X X X X X X X X X X X X X X X X X A A
F E D C B A 9 8 7 6 5 4 3 2 13Ø F E D C B A 9 8 7 6 5 4 3 2 12Ø F E D C B A 9 8 7 6 5 4 3 2 11Ø F E D C B A 9 8 7 6 5 4 3 2 1ØØ
[-----------CONTROL TABLE ADDRESS----------------Ø Ø Ø Ø Ø Ø]                                                          1[-]
                                                                                                                END OF FRAME
```

A--information needed at both top and bottom
B--information needed at the bottom of fifo
T--information needed at the top of fifo
Ø--field is always Ø
1--field is always 1
X--don't care

FIFO TOP CONTROLLER

FIFO BOTTOM CONTROLLER

GRAPHICS DISPLAY SYSTEM WITH VIEWPORTS OF ARBITRARY LOCATION AND CONTENT

BACKGROUND OF THE INVENTION

1. Field of the Invention

The present invention relates to a computer graphics display system in which the individual viewports or images produced on a video screen are of arbitrary arrangement, number, size and content.

2. Description of the Prior Art

Especially in computer-aided design (CAD) applications, it is desirable often to have two or more views of the same or related objects displayed simultaneously on the video display screen. An example is in the CAD design of chemical process plants, where thousands of pipes, valves, fittings and equipment interconnections must be integrated into a unitary system. A design engineer would benefit from having a graphics work station at which he could simultaneously display e.g., a plan or elevation view of a major portion of the plant, an enlarged perspective view of the immediate portion of the plant piping which is undergoing design, and pictorial or schematic views of the components that the engineer is now assembling into the system. An overall objective of the present invention is to provide such a graphics display system.

A highly desirable feature of such system is the arbitary number, size and location of such simultaneous images or "viewports" on the video display screen. Thus in the example of process piping design, an engineer may prefer to have totally different sets of views available when performing design tasks on correspondingly different sections of the process plant. A further object of the present invention is to provide a graphics display system in which the viewport arrangement is completely arbitrary.

Advantageously, the image content of each viewport should be selectable independently of the contents of the other viewports. On the other hand, the system should be sufficiently flexible to allow simultaneous display of the same graphics data in two or more viewports, for example, with different magnification ("zoom") factors. Advantageously, the system should be capable of inserting a background grid over any or all of the images, with arbitrary grid spacing that can be scaled in accordance with the image magnification factor. Corresponding cursor placement in two or more images of the same data also is desirable. A further object of the present invention is to provide a graphics display system having these capabilities.

The ability to pan across a stored graphics picture also is a desirable feature. Advantageously, the display system should permit independent panning in any of the simultaneously displayed viewports. This is another objective of the present invention.

Certain techniques for implementing zoom, panning and split screen display effects are disclosed in the inventors' U.S. Pat. No. 4,197,590 entitled METHOD FOR DYNAMICALLY VIEWING IMAGE ELEMENT STORED IN A RANDOM ACCESS MEMORY ARRAY, and in the corresponding RASTER SCAN DISPLAY APPARATUS U.S. Pat. No. 4,070,710 now reissued as U.S. Pat. No. RE 31,200. An objective of the present invention is to provide a graphics display system having a technique for viewport allocation and content which is different from, and more flexible than that disclosed in the inventors' referenced patents. On the other hand, certain features such as the pan and zoom techniques disclosed in those referenced patents advantageously may be incorporated with the present invention. Two other features which likewise may be incorporated with the present invention are background grid generation and toroidal panning. These techniques are disclosed in the inventors' U.S. Pat. No. 4,295,135 entitled "ALIGNABLE ELECTRONIC BACKGROUND GRID GENERATION SYSTEM" and application Ser. No. 274,355 now U.S. Pat. No. 4,442,495 entitled "TOROIDAL PAN". A further object of the present invention is to provide a graphics display system in which such zoom, pan, background grid and toroidal panning capabilities can be implemented independently and simultaneously in a plurality of viewports of arbitrary size and location.

SUMMARY OF THE INVENTION

These and other objectives are achieved in a graphics display system in which viewports of arbitrary location and content are defined by a set of control word sequences stored in a memory. Each such sequence is associated with a segment of a particular viewport. The sequence specifies what graphics data is to be displayed in that segment, and with what display parameters such as zoom factor, background grid scale and color. The sequence also specifies the interviewport spacing between this and the adjacent viewport on the video screen. The set of such control word sequences constitutes a "control table" which completely specifies an entire frame of the video display.

Graphics image or picture element ("pixel") data is stored in a pixel memory. This may be an independent memory or a separate region of the same memory which stores one or more control tables. Each control word sequence identifies the graphics data content of the corresponding viewport segment by specifying the memory address of that pixel data.

The actual video display is generated by alternately reading each control word sequence, obtaining the identified pixel data from the specified memory address, and processing this pixel data in accordance with the display parameter information contained in the control word sequence. The processed pixel data is supplied as a video raster signal to the display screen. The process is repeated sequentially for each of the control word sequences in the control table. This produces a complete frame of the video display.

The process is repeated for consecutive frames. If the same set of control word sequences is used, the display of each frame will be identical. If certain parameters of the display are to be changed, this is accomplished by changing some or all of the control word sequences. For example, if panning is to be implemented in a particular viewport, at the end of each frame, the control word sequences which define the graphics data content of that particular viewport are modified so as to identify the appropriate new set of graphics data required to produce the next frame in the panned image. If this modification of the control word sequences is not too extensive, it can be accomplished during the vertical (frame) retrace time of the video display. Alternatively, a pair of control tables may be established in the control memory which are used to generate alternate frames of the video display. While one control table is being used to produce the current frame, the other control table may be modified, for example, to define the new data addresses required for panning. This is a form of "double buffering".

When a new arrangement of viewports is desired, a new control table is established. In other words, a new set of control word sequences is provided which define the desired display.

In an illustrative embodiment, a first-in-first-out (FIFO) memory used to handle control parameters and pixel data. An inbound ("top") FIFO controller accesses the control words, inputs the control parameters to the FIFO memory, obtains the specified, associated pixel data and transfers this data to the FIFO memory.

An outbound ("bottom") FIFO controller obtains the control parameters from the FIFO memory and directs processing of the associated pixel data from the FIFO memory in accordance with these parameters. A pixel data serializer is used to provide the pixel data in serial form with the requisite replication, blanking and offset in the event that zoom is employed. Background grid and cursor information is inserted into the serialized data stream in accordance with grid and cursor parameters from the control word sequence. In a color system, color allocation may be defined by parameters such as a color base address. This is combined with the pixel data value to obtain a color map address which accesses the corresponding color video drive signal from a color map memory.

When output of a complete viewport segment is completed, as specified by a screen pixel count parameter, screen background (blank) signals are supplied to the video screen in accordance with the interviewport pixel count or width specified by the control word sequence. The process is repeated for each control word sequence under control of the inbound and outbound FIFO controllers so as to generate each frame of the video display.

BRIEF DESCRIPTION OF THE DRAWINGS

A detailed description of the invention will be made with reference to the accompanying drawings, wherein like numerals designate corresponding elements in the several figures.

FIG. 4 shows the formats of the control words included in each control word sequence of the control table illustrated in FIG. 3.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention since the scope of the invention best is defined by the appended claims.

Figure 1:
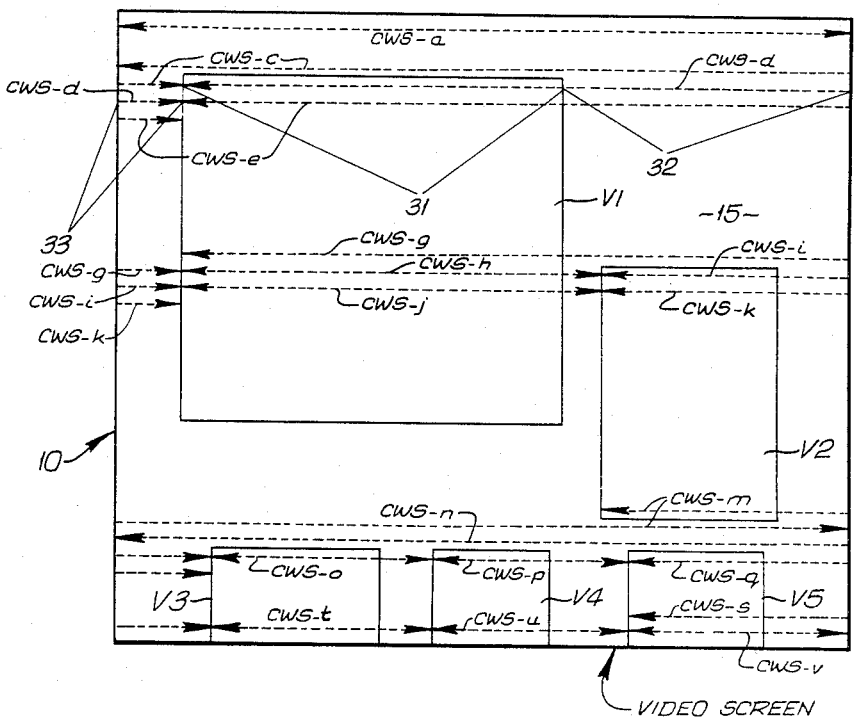
FIG. 1 is a pictorial view of a typical graphics display on a video screen produced in accordance with the present invention.
Figure 2:
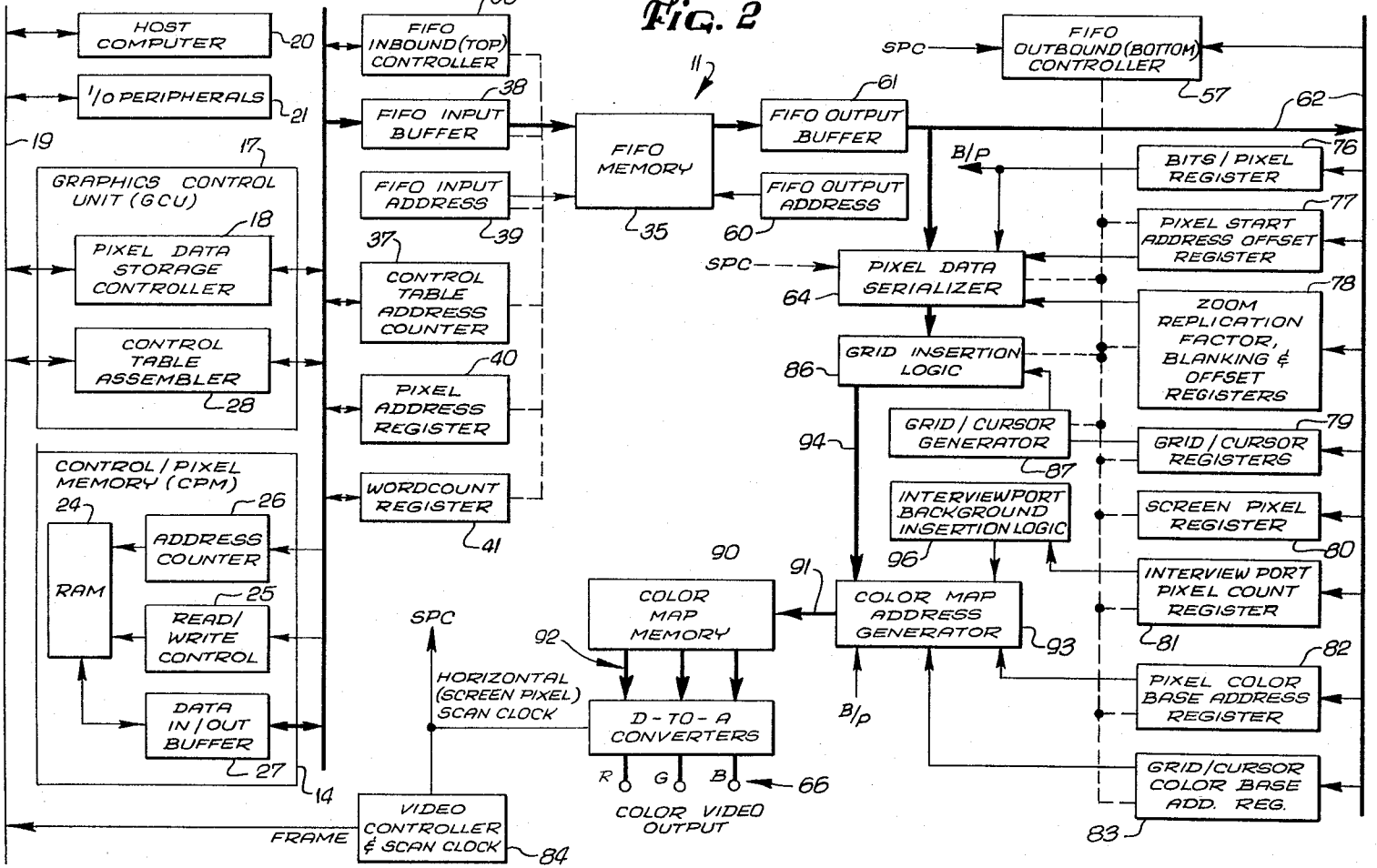
FIG. 2 is an electrical block diagram of a graphics display apparatus in accordance with the present invention.

FIG. 1 illustrates a typical display produced on a CRT or video screen 10 using the inventive graphics display system as implemented by the apparatus 11 of FIG. 2. In this display there are five viewports V1 through V5. In each such viewport there appears a separate graphics image. These images may be totally unrelated, or the image in one viewport may be, for example, an enlarged portion of the image in another viewport. The size, location on the video screen, and pictorial data content of each viewport is totally arbitrary. These factors are established by the contents of a set of control word sequences (CWS) which constitute a control table 12 or 13 (FIG. 3) that is stored in a portion of a control/pixel memory 14 (FIG. 2).

On the video screen 10, the interviewport regions 15, which contain no graphics images, likewise are defined by information (the "interviewport count") contained in the control word sequences. These screen regions 15 typically are blanked or of a uniform interviewport color.

For the illustrated system, there is at least one control word sequence for each scan line on the video screen 10. In FIG. 1, the portion of the screen display associated with each CWS is illustrated by a double pointed arrow. For example, the topmost scan line, which is entirely within an interviewport region, is specified by the control word sequence CWS-a. The interviewport space specified by a particular CWS may extend to the next video scan line. Thus in FIG. 1 the sequence CWS-c defines a video scan line which is entirely within an interviewport region, and the initial portion at the left side of the next video scan line which also is an interviewport space. This next scan line incorporates the topmost segment of the viewport V1. This segment is defined by the sequence CWS-d, which same sequence defines the remaining interviewport space to the right of the viewport V1 along the same scan line, as well as the initial interviewport space to the left of the viewport V1 along the following scan line. Additional like control word sequences CWS-e through CWS-g define that portion of the viewport V1 which is situated higher on the video screen than the top of the viewport V2.

The video scan line which incorporates the uppermost segment of the viewport V2 is defined by three control word sequences. These are CWS-g which specifies the left interviewport space, CWS-h which specifies a segment of the viewport V1 and the central interviewport space, and CWS-i which defines the uppermost segment of the viewport V2, the interviewport space at the right of the screen, and the interviewport space at the left of the screen along the next scan line.

At the bottom of the video screen 10, each scan line encompassing the three viewports V3, V4 and V5 is defined by four sequences such as CWS-n, CWS-o, CWS-p and CWS-q. As discussed below, the final control word sequence CWS-v includes information indicating that a video frame has been completed, and specifying the initial address in the control/pixel memory 14 of the first control word sequence for the next video frame.

To generate each frame of the video screen 10 display, two sets of information, namely a control table 12 or 13 and the appropriate graphics image (pixel) data, first must be established in the memory 14. This is accomplished by a graphics control unit (GCU) 17 in the apparatus 11.

The GCU includes a pixel data storage controller 18 which can receive graphics image data via a bus 19 from either a host computer 20 or a disc or other storage device which is one of the local input/output (IO) peripherals 21 directly associated with the apparatus 11. The controller 18 assigns the pixel data to storage locations in the memory 14. For example, the controller 18 may assign pixel data respectively associated with the viewports V1 through V5 to corresponding areas 22-1 through 22-5 (FIG. 3) in the memory 14. Advantageously, the controller 18 itself includes a memory in which is stored a list of the image data assignments in the memory 14.

Pixel data is transferred between the storage controller 18 and the memory 14 via a bus 23. The memory 14 includes a random access memory (RAM) 24, the read/-write status of which is established by a control circuit 25. The RAM memory locations to which data is entered or accessed are established by an address counter 26 which itself may be manipulated by the storage controller 18 via the bus 23. Data is transferred to the RAM 24 via the bus 23 and a data in/out buffer 27.

The graphics control unit 17 also includes a control table assembler 28 which establishes and enters into the memory 14 the control word sequences for each video screen frame. The assembler 28 receives information specifying the desired viewport parameters from either the host computer 20 or the peripherals 21 via the bus 19. Typically the peripherals 21 may include a data entry keyboard on which an operator can specify the size, location and desired image content of each viewport. The assembler 28 interprets this information and establishes the corresponding set of control word sequences to produce the desired display. The peripherals 21 also may include panning controls, such a joy stick or track ball, by means of which the operator can specify e.g., a desired direction and rate of panning. Input from these devices also is used by the assembler 28 to modify the panning parameters in the control word sequences associated with the viewport in which panning is to occur.

The controller 18 and the assembler 28 each may comprise a microcomputer having its own processor (such as a type 8086 CPU integrated circuit), bus interface circuitry, random access memory, and a stored program which directs the operation of the respective controller 18 and assembler 28.

Figure 3:
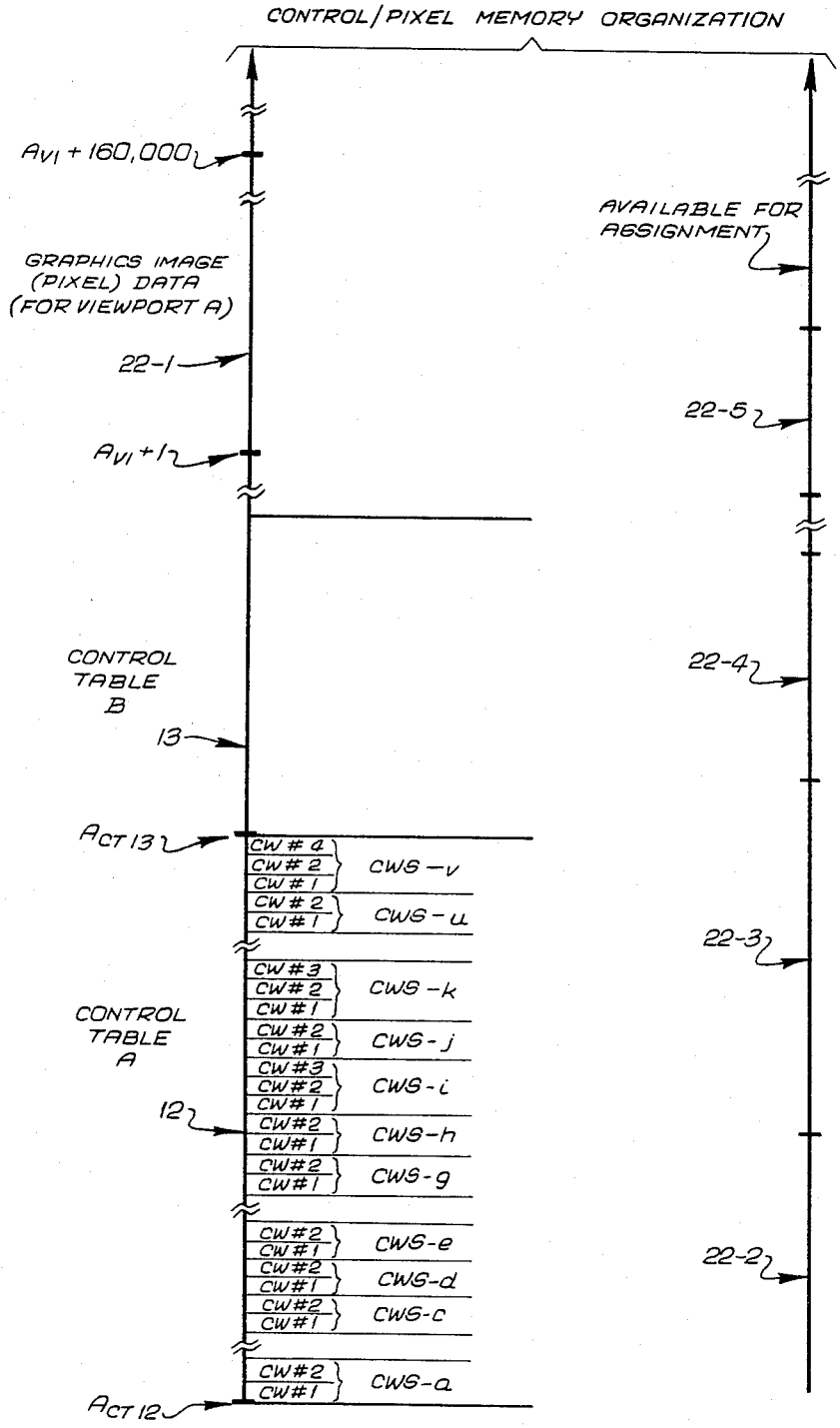
FIG. 3 is a pictorial representation of the typical contents of the control/pixel memory employed in the apparatus of FIG. 2, and showing a typical control table set of control word sequences.
Figure 7:
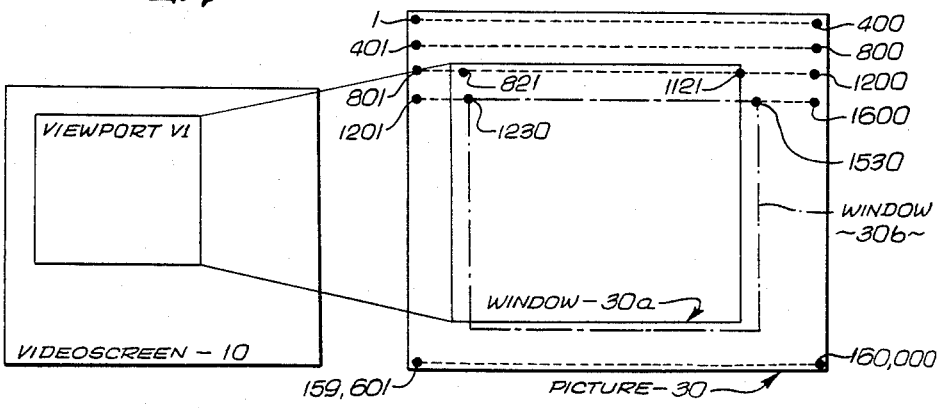
FIG. 7 is a pictorial representation showing the relationship between graphics image data in the pixel memory and the image produced in a viewport of the video screen.

An example of the manner in which graphics image data is assigned to storage locations in the memory 14 is illustrated in FIGS. 3 and 7 for pixel data used to create the viewport V1. Image data for a "picture" 30 (FIG. 7) is supplied to the controller 18 via the bus 19. By way of example, this may comprise 160,000 bits, of which each bit represents a single pixel of a black and white image. If the bit is "1", the pixel is black, if the bit is "0" the pixel is white. Alternatively, graphics data in vector format may be supplied to the GCU 17 via the bus 19 and converted into pixel data, for insertion into the memory 14, by the controller 18.

In the example of FIG. 7, these pixel bits represent a picture 30 having 400 horizontal lines each comprising 400 pixels. Thus the top line includes pixels 1 through 400, the second line includes pixels 401 through 800, etc.

The storage location assignment in the memory 14 of the 160,000 pixel bits which define the picture 30 is arbitrary. However, a convenient arrangement is to assign these bits to 160,000 consecutive storage locations beginning at a base address $A_{V1}+1$, as indicated in FIG. 3. This base address ($A_{V1}+1$), the number of bits per pixel (here, one bit per pixel), the number of pixels per line (here, 400), and the number of lines (here also 400) in the picture 30 then may be stored by the controller 18 in its image data assignment list. This entry thus defines the organization and storage locations in the memory 14 of the graphics data defining the picture 30. This information is then available to the assembler 28 for use in generating the control table 12 or 13.

In each control table, each control word sequence (CWS) consists of two or more control words which may have the formats illustrated in FIG. 4. There are four control word formats respectively designated CW#1 through CW#4. In the illustrated system, each CWS includes at least two control words, having the respective formats CW#1 and CW#2. If the CWS is associated with a viewport in which toroidal panning is used, an additional control word of format CW#3 is included. The last CWS in the table includes a control word of format CW#4 which designates the end of a frame.

The content of the various control words in the control table 12 or 13, and the manner in which these are established by the assembler 28, may be understood with respect to the following examples. The first example concerns the control word sequence CWS-d (FIG. 1) which encompasses the top scan line segment 31 of the viewport V1.

The user may specify, through an appropriate peripheral 21, the location, width (in number of screen pixels) and height (the number of scan lines) of the viewport V1. In the illustration of FIG. 1 the viewport V1 has a width of 300 pixels on the video screen 10, beginning from screen pixel location 51 (as counted from the left edge of the display) through screen pixel location 351. The height 350 scan lines. Toroidal panning is not to be used.

From the foregoing information, the assembler 28 will include in the control word sequence CWS-d two control words of respective formats CW#1 and CW#2. The viewport segment width (herein 300 screen pixels) will be entered into the "screen pixel count" field of the control word CW#1. By reference to the image data assignment list for the viewport V1, stored in the controller 18, the assembler 28 will obtain the value of the number of bits per pixel ("1" in the example) and insert this value into the "bits/pixel" field of the control word CW#1 (FIG. 4).

From the same image data assignment list, the assembler 28 will ascertain the base address ($A_{V1}+1$) width and height of the picture stored in the memory 14. The user will specify, via a peripheral 21, the location within the picture 30 of the "window" 30*a* (FIG. 7) that is to be displayed in the viewport V1. This can be specified, e.g., by designating the horizontal and vertical offset of the upper left hand corner of the window 30*a* with respect to the upper left hand corner of the picture 30.

Using this information, the assembler 28 can ascertain a memory 14 starting address of the first image pixel to be included in the displayed viewport segment 31. In the illustration of FIG. 7 this is image pixel 821 which will be stored in the memory location $A_{V1}+821$. This memory address is entered into the "memory pixel start address" (MPSA) field of the control word CW#2.

To facilitate rapid data output from the RAM 24, the memory 14 may be configured to access multibit words of data. For example, 64-bit words may be accessed from the RAM 24. In this case, it may happen that the storage address for the first pixel bit in the segment 31 does not fall on a word boundary, but rather is contained at some other position within a 64-bit word in the RAM 24. In this event, the least significant bits (designated "LSB" in FIG. 4) of the MPSA specify the offset from the word boundary of the initial pixel bit ($A_{V1}+821$) in the segment 31.

The number of words which must be accessed from the RAM 24 to obtain all of the image pixel bits for the viewport segment 31 also is calculated by the assembler 28 and entered into the "word count" field of the control word CW#2. For example, if 64-bit words are accessed from the RAM 24, and the segment 31 width is 300 screen pixels, with one bit representing each pixel, then five or six words (depending on the offset of the MPSA in the first word) will have to be accessed to obtain the pixel data for the complete scan line segment 31. The appropriate value (5 or 6) is entered into the "word count" field.

Additional display parameter information for the viewport V1 also may be entered into the control word sequence CWS-d. For example, these parameters include pixel color, zoom magnification, offset and blanking, background grid characteristics and grid or cursor color. These are further described below in connection with components of the apparatus 11 which implement the color, zoom, grid and cursor functions.

To complete assembly of the control word sequence CWS-d, the assembler 28 determines the interviewport spacing associated with the segment 31 of the viewport V1. In the display of FIG. 1, there is no viewport on the video screen 10 to the right of the segment 31. Thus the remainder 32 of the video scan line encompassing the segment 31 traverses only an interviewport space. In the example of FIG. 1, where the width of the video screen 10 is 600 screen pixels, this scan line region 32 has a length of 249 screen pixels.

Since this interviewport space 32 extends to the right edge of the screen 10, the same control word sequence CWS-d additionally is used to specify the interviewport space at the left side of the screen 10. In FIG. 1 this space 33 is 50 screen pixels wide. The sum of the number of screen pixels in the interviewport spaces 32 and 33 (herein 249+50=299) is entered into the "interviewport count" (IVPC) field of the control word CW#1.

An entry next is made into the "continuation" bit field of the control word CW#2. This bit will be "0" since the sequence CWS-d relates to a viewport V1 in which no toroidal panning is used, and hence in which no control word of format CW#3 is included. If toroidal panning were used with this viewport, the CW#2 continuation bit field would be set to "1" and a control word of format CW#3 would be included in the control word sequence. This continuation word would specify the additional portion of the picture 30 data which must be utilized by the apparatus 11 to produce the desired viewport image.

The assembler 28 sets up the remaining control word sequences in the control table 12 or 13 in the manner just described. However, in the final sequence for each frame, the assembler 28 inserts a control word of format CW#4. For example, the sequence CWS-v will contain such a word of format CW#4 which indicates, by the bits "10" in the "end of frame" field that the frame is now complete.

One function of the control word CW#4 is to indicate the starting address in the memory 14 of the first control word sequence (e.g., sequence CWS-a) of the control table which is to be used for generation of the next display frame. This address is entered into the "control table address" field of the CW#4 word.

In the example of FIG. 3, the starting address for the control table 12 is designated $A_{CT12}$ and the starting address for the control table 13 is designated $A_{CT13}$. If the video display for the next frame is to be exactly the same as the current frame, the same control table can be used for that succeeding frame. Thus if the control table 12 is being used to produce the current frame, the word CW#4 in the sequence CWS-v may contain the address $A_{CT12}$ in the "control table address" field. On the other hand, if the display is to be changed on the next frame, the control table to be used for that display may be either the control table 12 (with appropriate modifications carried out during the display vertical retrace time) or the control table 13 (which may have been assembled during the production of the current display frame). In the latter case, the final word of format CW#4 in the control table 12 will contain in the "control table address" field the initial address $A_{CT13}$ of the control table 13 to be used during generation of the next frame.

An alternate use of the control word of format CW#4 is to change the control table address during the production of a single frame. In the organization of FIG. 3, the control word sequences in the control table 12 are arranged in appropriate sequential order in the memory 14. However, this is not required. Different portions of the control table may be located in different, non-contiguous portions of the memory 14. In this instance, the final control word sequence located in one portion of the memory may include a control word CW#4 which specifies, in the "control table address" field, the address in the memory 14 of the beginning of the next portion of the same control table. In that event, the "end of frame" field of the control word CW#4 will contain the bits "11".

The apparatus 11 utilizes the control table information to direct accessing of the image data from memory, and processing of this image data in accordance with the specified display parameters so as to produce the desired display. In the embodiment of FIG. 2, this is accomplished with the aid of a first-in-first-out (FIFO) memory 35 which handles both pixel data and display parameter portions of the control word sequences. In general these control word parameters are entered into the FIFO memory first, followed by the image data which is to be processed in accordance with those parameters. In FIG. 4, the display parameters which are transmitted through the FIFO memory 35 are designated by the letters A and B. These are used on the outbound "bottom" (B) side of the FIFO memory 35. For most efficient data transfer between the memory 14 and the FIFO memory 35, each entire control word of format CW#1, CW#2 or CW#4 is entered into the FIFO memory 35, but only the portions of these words designated A or B in FIG. 4 are utilized at the outbound side of the memory 35.

The inbound or "top" (T) side of the FIFO memory 35 is controlled by an inbound or top controller 36. It uses portions of the control words designated by the letters A and T in FIG. 4.

To produce a video screen display, the inbound controller 36 sequentially accesses the control word sequences from the applicable control table. The address of the control word next to be accessed is maintained in a control table address counter 37. As each CWS is accessed, the parameter data required at the outbound side of the FIFO memory 35 (designated by the letter A or B in FIG. 4) is transferred to the FIFO memory 35 via a FIFO input buffer 38. An appropriate FIFO input address counter 39 designates the location in the FIFO memory to which this parameter data is entered. In the preferred embodiment, the entire control words which contain the required parameter data are transferred into the FIFO memory 35.

After entering the control words or parameter data from a particular control word sequence into the FIFO memory 35, the inbound controller 36 accesses from the memory 14 the image data specified by that CWS. The initial memory pixel storage address (MPSA) and word count from the sequence are entered respectively into a pixel address register 40 and a word count register 41. The controller 36 uses the contents of the registers 40 and 41 to direct accessing of the requisite pixel data from the memory 14. The controller 36 then enters this pixel data into the FIFO memory 35 at address locations immediately following the parameter data obtained from the associated CWS.

Figure 5:
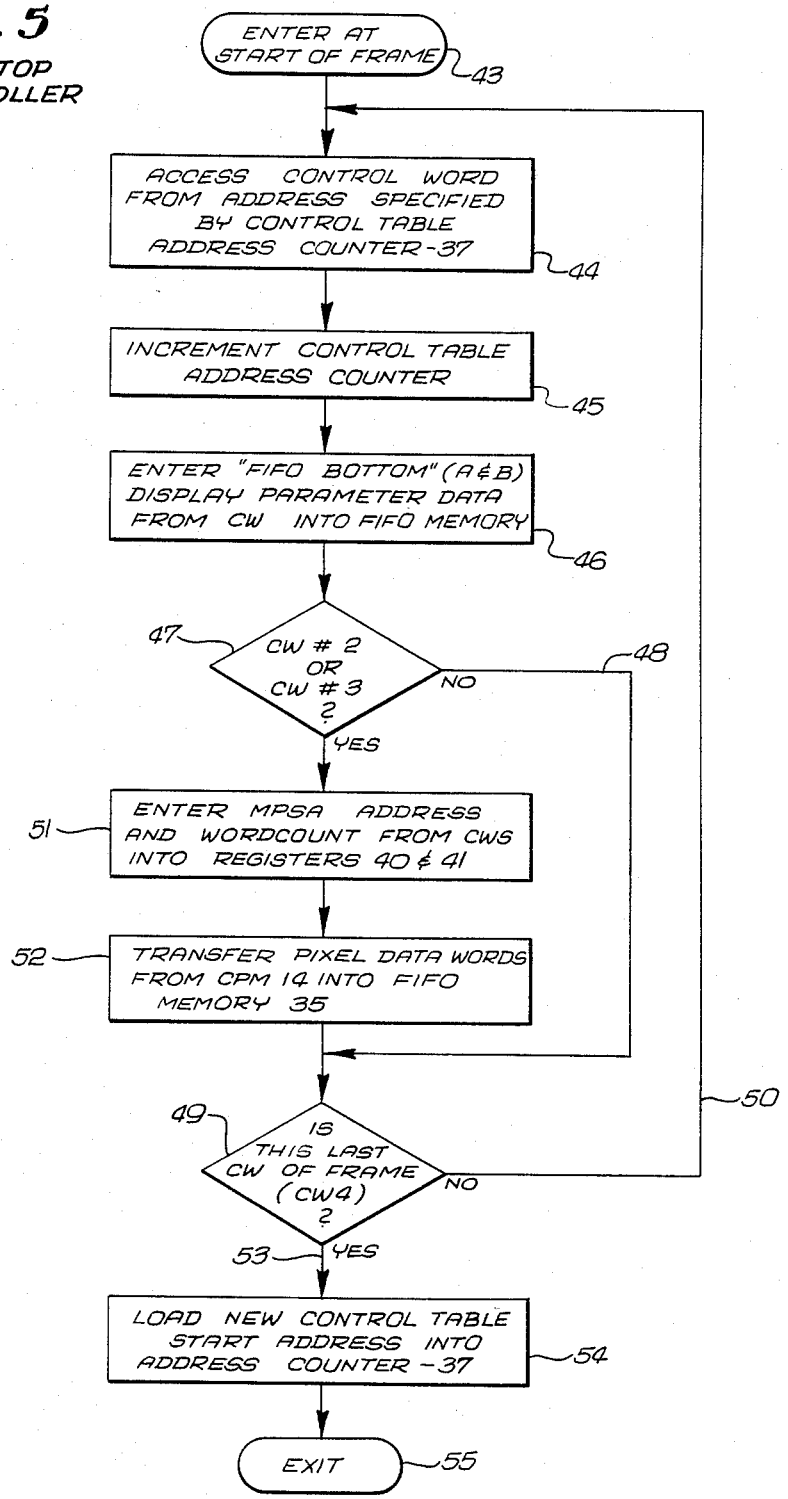
FIG. 5 is a flow chart describing the sequence of operation of the inbound FIFO controller components of the apparatus of FIG. 2.

This operation of the FIFO top controller 36 is summarized in the flow chart of FIG. 5. The operation begins (block 43, FIG. 5) at the start of a video frame. The controller 36 obtains from the address counter 37 the address of the first CWS in the applicable control table. Typically, this initial address will have been entered into the counter 37 from the "control table address" field of the last control word CW#4 used in the preceding frame. The controller 36 then accesses the applicable CWS from the specified address (block 44, FIG. 5). The counter 37 then is incremented (block 45) to point to the address of the next control word.

If the accessed control word contains display parameters to be used at the outbound side of the FIFO memory 35 (designated A or B in FIG. 4), the controller 36 enters these parameters (block 46) into the memory 35. For example, for the sequence CWS-d described above, the interviewport count, the bits/pixel value and the screen pixel count from the control word CW#1 will be transferred to the FIFO memory 35. Alternatively, the entire control word (of type CW#1, CW#2 or CW#4) may be loaded into the FIFO memory 35, with the outbound controller 57 accessing from the memory 35 only those portions of each control word which are used on the outbound wide. Such control words, as well as the associated pixel data words, are treated as entire word entities at the input side of the FIFO memory 35, thereby simplifying the configuration of that memory. This also reduces the requisite speed of operation of the control/pixel memory 14 which supplies words to the FIFO memory 35 input.

A test is made (block 47, FIG. 5) to determine if this is a control word of format CW#2 or CW#3. If not, the exit path 48 is taken and a further test is made to determine if this is a control word of format CW#4 (block 49). If not, the exit path 50 is taken and the steps 44 through 47 are repeated.

If the control word is of type CW#2 or CW#3, the controller 36 must obtain the designated pixel data from the memory 14 and enter it into the FIFO memory 35. To accomplish this, the designated memory pixel storage address and word count from the control word are entered into the registers 40 and 41 (block 51, FIG. 5). In the example described herein, since data is read from the RAM 24 in word format, only the portion of the MPSA designating the word boundary is entered into the register 40. This portion of the address is designated by the letters T in the MPSA field of the control word CW#2 in FIG. 4. The controller 36 then transfers the requiste pixel data words from the memory 14 into the FIFO memory 35 (block 52, FIG. 5). In the event that the FIFO memory 38 is temporarily full, which is possible because it is advantageously designed to be filled faster then emptied, the controller 36 will wait to accomplish the data transfer until space is available in the FIFO memory 35. (This is also true of the operation of block 46, FIG. 5.) For the control word sequence CWS-d, this pixel data transfer would begin from the memory word containing the initial pixel data address $A_{V1}+821$, and would continue for either five or six words as designated by the present contents of the word count register 41.

This process is repeated sequentially for all of the control word sequences in the control table. Note that the information entered into the FIFO memory is alternately display parameter data followed by graphics image data. Since the CWS's are accessed sequentially, the information flowing through the FIFO memory 35 will be in the requisite order for ultimate supply to the video screen so as to produce the raster display typified by FIG. 1.

When the final CWS of the frame is reached, an end of frame control word of format CW#4 will be detected (at block 49). This will be indicated by the status bits "10" in the "end of frame" field. The exit path 53 will be taken, and the initial address for the control table to be used during the next frame will be transferred from the "control table address" field of the word CW#4 into the address counter 37 (block 54). The operation of the inbound controller 36 then is exited (block 55) in readiness for the start of the next frame.

Figure 6:
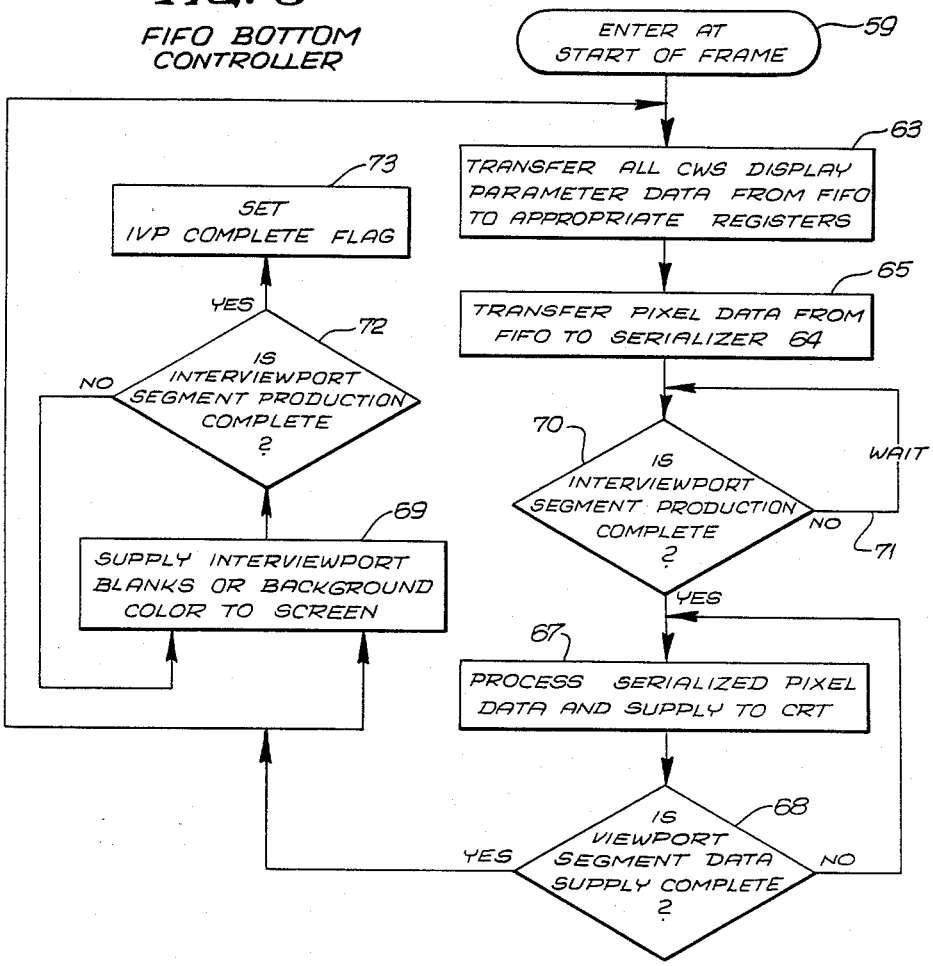
FIG. 6 is a flow chart showing the sequence of operation of the outbound FIFO controller components of the apparatus of FIG. 2.

Operations on the outbound (bottom) side of the FIFO memory 35 are governed by a controller 57 the operation of which is summarized by the flow chart of FIG. 6. The operation begins at the start of a frame (block 59).

The first data received from the FIFO memory 35 will be the display parameters for the initial control word sequence. This data will be obtained from the address specified by a FIFO output address counter 60 and will be transferred via a buffer 61 onto a bus 62. The display parameters are transferred (block 63, FIG. 6) into appropriate registers associated with the bus 62. The controller 57 then transfers the pixel data designated by the CWS from the FIFO memory 35 via the buffer 61 to a pixel data serializer 64 (block 65).

Thereafter, the serialized pixel data is processed in accordance with the stored display parameters and ultimately supplied to the CRT or video screen 10 via output terminals 66 (block 67, FIG. 6). Such pixel data supply results in the production of a single viewport segment on the screen 10.

When the viewport segment data supply to the CRT is completed (block 68), "blanks" or interviewport color data is supplied via the terminals 66 to the CRT to produce the interviewport segment specified by the current CWS (block 69).

While the interviewport segment is being produced, the controller 57 may begin the transfer out of the FIFO memory 35 of the display parameter data and pixel data associated with the next CWS. However, the processing and supply of this next viewport segment data is held up until the interviewport space presently being produced is completed. This is tested (block 70, FIG. 6) e.g., by interrogating an "IVP complete" flag. If the flag is not set, an exit path 71 is taken and the controller 57 waits until the interviewport space production is completed before supplying the next viewport pixel data to the CRT.

As "blanks" or interviewport color data is supplied to the CRT to produce the interviewport segment, the number of screen pixels covered by such "blanks" is compared with the desired interviewport segment length (block 72, FIG. 6). When the interviewport segment is completed, the "IVP" complete flag is set (block 73). This enables the controller 57 (at block 70) to initiate pixel data transfer (block 67) to the CRT to produce the next viewport image segment.

The operations summarized by FIG. 6 are carried out by the FIFO bottom controller 57 and the various circuits associated with the FIFO output bus 62. By way of example, the operation of these circuits will be described for the processing of the typical control word sequence CWS-d.

While the interviewport space designated by the preceding sequence CWS-c is being completed, the control parameter data for the sequence CWS-d is obtained from the FIFO memory 35 and directed to the appropriate registers. Specifically, the number of bits per pixel is provided to a bits/pixel register 76, the pixel start address offset value (i.e., the least significant bits from the MPSA field of control word CW#2) is directed to a register 77, the various zoom and grid or cursor parameters are supplied to sets of registers 78 and 79, the screen pixel count is entered in a register 80, the interviewport screen pixel count is stored in a register 81, and various color parameters are stored in the registers 82 and 83.

After transfer of the parameter data to the registers 76–83, the bottom controller 57 initiates transfer of the associated pixel data words from the FIFO memory 35 to the serializer 64. Upon completion of production of the preceding interviewport space, the controller 57 initiates serialization and processing of these pixel data words. The serialization is carried out sufficiently rapidly so as to supply pixel data to the video output terminals 66 at a rate commensurate with the vertical scanning of the CRT. The scan rate is established by a video controller and scan clock circuit 84.

Figure 8:
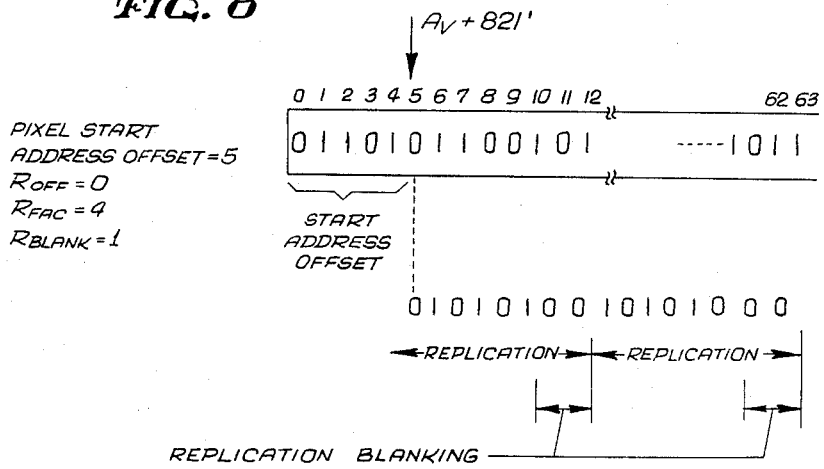
FIG. 8 is a diagram showing pixel data replication during production of a zoomed image in a viewport.

When the first word of pixel data is serialized by the circuit 64, the initial data bit which is outputted is ascertained by the address offset value from the register 77. This is illustrated in FIG. 8, where the block 85 represents the typical pixel data content of a 64-bit word as received from the FIFO memory 35. In the example, the start address offset value is "5". This signifies that the initial bit of the pixel data for the viewport segment 31 (FIG. 1) is situated at the sixth bit position in the initial word 85 read from the memory 14. In other words, this position corresponds to the address $A_{V1}+821$ in the example described above. Accordingly, the serialized pixel data supplied from the circuit 64 begins with the data bit in the position designated "5" of the word 85.

If a background grid is employed, certain grid insertion logic 86 superimposes bits into the serialized pixel data stream at appropriate intervals so as to produce a background grid which overlays the graphics image in the viewport V1. The superimposed grid data is supplied by a generator 87 in response to certain grid parameters obtained from the control word sequence CWS-d and stored in a register 79. These parameters may include a grid type designation, and grid spacing along the horizontal axis e.g., in terms of number of pixels between adjacent vertical grid lines. The parameters may also include a grid offset value that specifies the location of the left most vertical grid line with respect to the left edge of the viewport V1.

The grid generator 87 may be of the type described in the inventors' U.S. Pat. No. 4,295,135. Alternatively, other types of grid generation circuits may be used. The generator 87 advantageously may produce different types of background grids, as specified by the "grid type" field of the control word CW#1. For example, one type of grid may have high intensity vertical lines separated by a number of intermediate vertical lines of lesser intensity. The circuit 87 also may be configured to superimpose appropriate bits into the serialized data stream so as to produce a cursor for the viewport V1.

In the example described above, each graphics image pixel for the viewport V1 was represented by a single bit of data, which bit designated either black or white as the display color. However, color graphics images readily can be stored and produced by the apparatus 11. To this end, a color map memory 90 is employed. This device stores appropriate sets of red, green and blue (RGB) control signals which when simultaneously applied to a color video display cause the production of certain colors. Each such set is stored at different corresponding locations in the memory 90. Thus when a certain address value is supplied to the memory 90 via an input 91, the color map memory 90 produces on three output lines 92 the set of RGB control signals which will produce the color associated that memory address.

To take advantage of this color facility, each graphics image pixel for the viewport V1 may utilize a set of two or more bits per pixel. For example, by using four bits per pixel, $2^4=16$ different colors may be identified. That is, for each image pixel, the value of the associated four bits will specify the particular color in which that bit is to be displayed on the video screen 10.

The plural graphics image bits which represent each pixel may themselves constitute the address for the color map memory 90. Alternatively, the map memory address may be produced in an address generator 93 by combining the image data bits associated with each pixel with a certain pixel color base address. The base address may be supplied from the "pixel color base address" (PCBA) field of the control word CW#1 (FIG. 4) and stored in the register 82. The combined address then is used to access the color map memory 90.

This latter approach allows considerable flexibility. For example, the color map memory 90 may include several sets of color values. In one set a certain configuration of pixel bits (e.g., the bits "0100") may represent one color (e.g., brown), while in a different set the same pixel bits may represent a different color (e.g., yellow). The choice of which color mapping is used will depend on the content of the pixel color base address register 82.

With this arrangement, as each serialized set of pixel bits is supplied on the line 94 (after optional grid data insertion in the logic 86), the color base address is combined with the pixel bits in the generator 93 to produce a color map memory access address on the line 91. In response to this, the designated RGB color control signals are produced on the lines 92. These are converted to analog form in appropriate digital-to-analog converters 95 which are clocked by horizontal (screen pixel) scan clock pulses from the video controller 84. The resultant RGB analog outputs are supplied via the terminals 66 to the CRT to produce the desired color pixel display.

The inserted grid and/or cursor data likewise may be in the form of multiple bits per pixel, so as to produce a colored background grid or cursor. The inserted grid pixel bits thus may directly comprise an address for the color map memory 90, or may be combined in the address generator 93 with a separate grid/cursor color base address (GCBA) value obtained from the GCBA field of the control word CW#1 and stored in the register 83.

As graphics image data is supplied to the CRT to produce the scan line segment 31 of the viewport V1 image, the number of produced screen pixels is compared with the screen pixel count, stored in the register 80, which specifies the width of the viewport V1. The comparison may be carried out in the controller 57 which receives the screen pixel clock (SPC) signals from the video controller 84 and which accesses the register 80 via the bus 62. When the actual screen pixel count equals the value in the register 80, generation of the viewport segment 31 is complete, and the controller 57 terminates the supply of pixel data to the CRT.

Simultaneously, the controller 57 initiates a supply of "blanks" or interviewport color data by certain interviewport insertion logic 96. If a color is desired for this background, the logic 96 may supply an address designator to the color map address generator 93 which in turn provides a corresponding address to the memory 90 so as to produce the requisite color control signals at the output terminals 66.

The number of interviewport pixels that are supplied to the CRT is established by the interviewport count value obtained from the control word CW#1 and stored in the register 81. As the "blanks" or interviewport color data is supplied to the CRT, the number of resultant screen pixels is compared with the interviewport count value. This comparison is carried out by the controller 57. If the interviewport segment extends to the next video scan line (as is the case for the sequence CWS-d illustrated in FIG. 10), interviewport color insertion is suspended during the horizontal retrace time, but continues at the beginning of the next scan line. The interspace pixel count likewise is interrupted during the horizontal retrace time, but continues at the beginning of the next scan line.

Eventually, the number of produced interviewport pixels will equal the interviewport count from the register 81. When this occurs, the interviewport segment has been produced completely, and the controller 57 terminates the interviewport insertion operation of the circuit 96. The entire portion of the video screen display defined by the control word sequence CWS-d then is complete. As described in connection with the flow chart of FIG. 6, the controller 57 then initiates data generation in accordance with the next control word sequence CWS-e.

If a zoom or magnified display is requested for a certain viewport, certain zoom parameters are placed in each control word sequence associated with that viewport. For example, a magnification factor of four may be implemented for the image in the viewport V1 by replicating each stored image pixel four times in the horizontal direction, and replicating the same information for four consecutive horizinal scan segments on the video screen 10.

To accomplish such zoom operation, a zoom replication factor (RFAC) is entered into the corresponding field of the control word CW#1. For a magnification of four, the value "4" is entered in this field. In the zoomed display, it may be desirable to blank out one or more of the replicated bits. For example, with a zoom factor of four, it may be desirable to replicate each pixel only three times and in place of the fourth replication insert a blank. In this way, each pixel in the window 30 (FIG. 7) will appear in the viewport V1 as a block of 3×3 screen pixels, separated from the adjacent block by a blank border that is one screen pixel wide. If such a display is desired, the number of replicated bits which are to be blanked is specified in the "RBLANK" field of the control word CW#1.

It may be desirable, because of the location of the window 30*a* in the picture 30 (FIG. 7) not to replicate the left most pixel in the viewport V1 to the same extent as the remaining pixels. In this instance, the value entered in an "replication offset" (ROFF) field of the control word CW#2 indicates the number of screen pixels to be generated by the first memory pixel in the scan line segment.

The zoom parameters RFAC, RBLANK and ROFF are entered into the registers 78. They are utilized by the pixel data serializer 64 to implement the zoom. This is illustrated in FIG. 8 for the values ROFF=0, RFAC=4 and RBLANK=1, for the situation where each image pixel is represented by two bits.

The first pixel, represented by bits 5 and 6 of the 64-bit word 85, has the value "01". Since the replication factor is four, these two bits normally would be repeated four times, to produce the serialized data stream "01010101" in which the left most bit is supplied first on the line 94, followed by the other bits. However, the replication blanking factor "RBLANK=1" designates that the final replication is to be a blank. This is represented by the pixel value "00". Thus the two data bits (in positions 5 and 6) are replicated, with blanking, as the serial data stream "01010100".

The next pixel (represented by the bits 7 and 8) has the value "10". This is replicated with blanking to yield the serialized data stream "10101000". In each instance, the resultant replicated and blanked data stream is supplied by the pixel data serializer 64 via the line 94 to the color map address generator 93. The resultant viewport segment 31 thus will contain three screen pixels and one blank for each graphics image pixel obtained from the memory 14.

To obtain replication in the vertical direction, the identical memory pixel start address, word count and display parameter values that are utilized in the sequence CWS-d are repeated for the next two control word sequences that define the viewport V1. In the next following sequence, a blank line segment is produced, corresponding to the replication blanking in the vertical axis. (A totally blank line may automatically be produced under control of the outbound controller 57 if a "1" bit is entered into the "total blank line" field of the control word CW#2.)

To accomplish panning of the graphics image within a particular viewport, slightly different windows (FIG. 7) are used to define the graphics image data from the picture 30 which is to be included in the viewport on consecutive frames. For example, panning of the image in the viewport V1 may be accomplished in the following way.

During an initial frame the window 30*a* is displayed in the viewport V1 as described hereinabove. In the example given, the control table 12 (FIG. 3) is used to establish the viewport V1 image, and the sequence CWS-d initiated image production from data stored at the memory position $A_{V1}+821$.

For panning, while the first frame is being produced from the control table 12, the control table assembler 28 produces in the memory 14 a separate control table 13 similar to that of control table 12. However, now the control word sequences associated with the viewport V1 identify pixel data addresses associated with the different window 30*b* shown in FIG. 7. The window 30*b* is offset in the picture 30 downward and slightly to the right of the initial window 30*a*. The memory storage address for the upper left hand corner pixel in the window 30*b* is $A_{V1}+1230$. This address will be specified in the CWS-d that is assembled in the control table 13. The remaining control word sequences in the table 13 will likewise reflect the new window 30*b*.

At the end of generation of the frame defined by the control table 12, the final sequence CWS-v will identify the starting address ($A_{CT13}$) for the control table 13 which is to be used during the next frame. Since the new control table 13 causes the new window 30*b* to be displayed in the viewport V1, the image in the viewport V1 will appear to have moved. This process is repeated during successive frames, with continued production of successively different window data. As a result, a panning effect will be achieved for the image in the viewport V1.

It is apparent that only a limited extent of panning can be accomplished with the set of picture 30 data that is stored in the memory 14. Expressed differently, during the panning operation just described, the effective window will soon reach a boundary of the picture 30 (FIG. 7).

However, panning over a larger effective picture can be accomplished by periodically replacing the picture 30 image data in the memory 14. This can be done under control of the pixel data storage controller 18, using as a source of additional picture data which is to be used during the next frame, either the host computer 20 or an appropriate I/O peripheral 21 such as a disc. The picture 30 can be replaced entirely, or can be replaced in sections, one strip at a time. Advantageously, the updating and window generation can be done with "toroidal wraparound", as described in the inventors' copending U.S. patent application, Ser. No. 274,355 entitled "TOROIDAL PAN".

Figure 9:
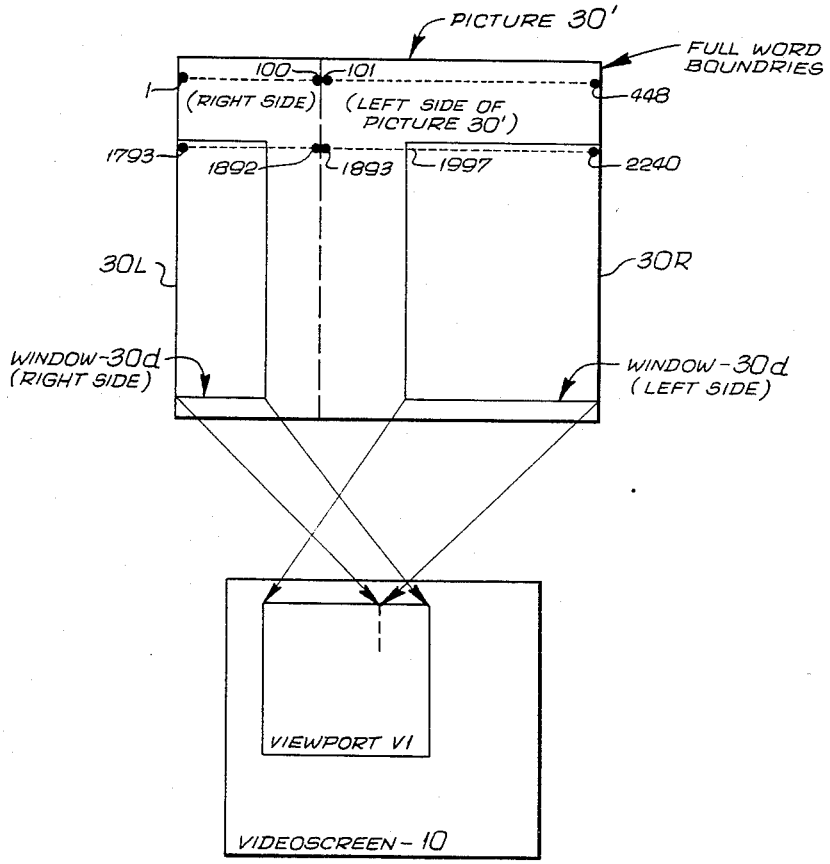
FIG. 9 is a pictorial representation showing the relationship between graphics image data in the pixel memory and the image produced in a viewport of the video screen during toroidal panning.

During toroidal panning operation, at certain times the image which defines a single picture may be contained in two or more non-consecutive portions of the memory 14. This is illustrated in FIG. 9, wherein pixel data respectively defining the right and left sides of the picture 30' are in non-consecutive portions of the memory 14. The pixel data which defines a single scan line segment of the viewport V1 thus will wrap over from the right boundary 30R of the picture 30' to the left boundary 30L.

In such instance, the control word sequence which describes each scan line segment of the resultant viewport V1 will have: (a) a first control word of format CW#2 which identifies pixel data for the left side of the window 30*d*, up to the right boundary 30R of the picture 30', and which has its continuation bit set to "1", followed by (b) a control word of format CW#3 which identifies pixel data for the right side of the window 30*d*, beginning at the left boundary 30L.

In the example of FIG. 9, the control word sequence which defines the top scan line segment of the viewport V1 will contain a first control word of format CW#2 which specifies the address 1997 as the memory pixel start address in the MPSA field. This start address (1997) need not fall on a full word boundary of the data in the memory 14. As discussed hereinabove, if this start address is not on a word boundary, the least significant bits (LSB) in the MPSA field of the CW#2 control word will cause only the correct pixel data to be utilized at the outbound side of the FIFO memory 35. Advantageously, however, the pixel data storage controller 18 will have made pixel data assignments into the memory 14 such that the boundaries 30R and 30L of the picture 30 will fall exactly on full word boundaries. For example, in FIG. 9, the picture 30' has a total width of seven times 64-bit words. With such arrangement, a "seamless wraparound" will be achieved.

Specifically, the contents of the word count field of the control word of format CW#2 will be such that the last pixel data word accessed from the memory 14 and supplied to the FIFO memory 35 will contain the pixel data through and including the pixel which falls on the boundary 30R. (In the example of FIG. 9, this is contained at memory position 2240, which is herein assumed to be most significant bit of a full word in the memory 14.) In the same control word sequence, the next control word will be of format CW#3. It will contain in the MPSA field the start address (herein 1793) for the top scan line segment of the right side of the window 30*d*. Advantageously, this memory position will fall on a full word boundary (i.e., the first pixel data bit will be in the least significant bit position of a full word).

Note from FIG. 4, that no portion of the control word of format CW#3 is utilized at the outbound side of the FIFO memory 35. Accordingly, the FIFO top controller 36 does not supply any portion at all of such control word to the FIFO memory 35. Rather, the controller 36 immediately supplies to the FIFO memory 35 the pixel data words identified by the MPSA field of the control word CW#3. These pixel data words (which define the right side of the window 30*d*) will immediately follow in the FIFO memory 35 the pixel data identified by the control word of format CW#2 which define the left side of the window 30*d*.

The screen pixel count parameter specified by the control word of format CW#1 of the same sequence will specify the total width of the viewport V1, including both the left and right sides of the window 30*d*. Accordingly, when the FIFO outbound controller 57 accesses the pixel data from the FIFO memory 35, this data will be supplied to the serializer 64 in a continuous manner, just as though the entire scan line segment pixel data had been obtained in the first instance from contiguous memory addresses in the pixel memory 14. A "seamless wraparound" is achieved.

The foregoing arrangement has the additional benefit of reducing the memory access speed requirements of the pixel memory 24 and the input side of the FIFO memory 35. This is so, since advantageously only full word transfers are made from the control/pixel memory 14 to the FIFO memory 35.

We claim:

1. A graphics display system of the type in which pixel data stored in a pixel memory is accessed and displayed on a video screen, said system facilitating the arbitary screen location and pixel content of one or more viewports, comprising:

control memory means for storing a control table comprising a set of control word sequences each consisting of one or more control words, each sequence specifying the portion of said stored pixel data which is to be displayed in a corresponding segment of a viewport associated with that sequence, and specifying other display parameters for said associated viewport, first controller means for accessing from said pixel memory the pixel data portion specified by each control word sequence, and second controller means for displaying said accessed pixel data portion in accordance with said display parameters specified by the associated control word sequence, said first and second controller means operating repetitively in accordance with consecutive control word sequences to produce a complete screen display in which the viewport arrangement and content are defined by said sequences.

2. A graphics display system according to claim 1 wherein said other display parameters include a value specifying the interviewport space separating adjacent viewports on said video screen, said second controller means beginning the display of accessed pixel data for one viewport only after the adjacent interviewport space has been produced on said screen.

3. A graphics display system according to claim 1 wherein said corresponding segment is a portion of a single scan line on said video screen.

4. A graphics display system according to claim 1 or 2 wherein there is at least one control word sequence per scan line, an interviewport space parameter of each sequence specifying the space on each video scan line between the viewport segment defined by said control word sequence containing that interviewport space parameter and the viewport segment defined by the next successive control word sequence, the interviewport space parameter associated with the last viewport segment in a scan line defining both the interviewport space between that segment and the end of that scan line and the interviewport space at the beginning of the next scan line.

5. A graphics display system according to claim 1 wherein said display parameters of a control word sequence include zoom replication factors, said second controller means including means for replicating said accessed pixel data portion in accordance with said replication factors, thereby producing a magnified display in the associated viewport.

6. A graphics display system according to claim 1 wherein said other display parameters are selected from the group consisting of interviewport spacing, zoom replication factors, background grid display factors, and color map selection parameters.

7. A graphics display system facilitating the display on a video screen of plural different viewport images each having different display parameters and being arbitrarily situated on said screen, comprising:

a pixel memory storing graphics image pixel data, a stored control table containing a set of control word sequences each consisting of at least one control word, each control word sequence specifying the parameters of a segment of a single viewport to be produced along a single video scan line, said parameters including the pixel memory storage address of pixel data for that viewport segment and the interviewport spacing between that viewport segment and the next viewport segment to be produced on the same or the next video scan line, and means for utilizing said control word sequence to direct the display of said pixel data from said pixel memory onto said video screen in accordance with the parameters and interviewport spacings specified by said control word sequences to produce a video display defined by said control table.

8. A graphics display system according to claim 7 wherein said means for utilizing comprises:

first means for sequentially reading said control word sequences from said table as said video display is being produced on the screen, second means for accessing from said pixel memory, for each read control word sequence, the pixel data specified by that read control word sequence and supplying said accessed pixel data serially to the video screen to produce the associated viewport segment, and third means for thereafter producing an interviewport space on said video screen in accordance with the interviewport spacing parameter of each control word sequence, said first, second and third means operating repetitively to produce a complete display on said video screen.

9. A graphics display system according to claim 7 including two stored control tables, alternate ones of said control tables being used during production of alternate frames of the video display.

10. A video graphics display system comprising:

a video screen, a control/pixel memory means for storing graphics display pixel data and control words each specifying display parameters for a portion of the video screen, a first-in-first-out (FIFO) memory, an inbound FIFO controller means for alternately supplying to said FIFO memory display parameters of one or more control words and graphics display data identified by the supplied control words, said alternate supplying occurring repetitively and sequentially for a plurality of control words defining a complete frame of a video display, and an outbound FIFO controller means for alternately obtaining from said FIFO memory said display parameters and the identified graphics display data, and for converting and supplying to the video screen the obtained graphics display data in accordance with the obtained display parameters.

11. A video graphics display system according to claim 10 wherein each control word includes display parameters defining the segment width of a certain display image segment to be contained on a portion of a single video scan line and the spacing between that certain image segment and the next image segment on the same or the next scan line, said outbound FIFO controller means comprising:

a segment width register for storing the segment width parameter of each control word and means for terminating the supply of graphics display data to said video screen when the supplied amount of graphics display data produces an image segment display on said screen having a width equal to the contents of said segment width register, and a between-image spacing register for storing the between-image spacing parameter from each control word and means for supplying to the video screen control signals causing the display of a blank or background segment, said supply of background control signals beginning upon said termination of supply of graphics display data and terminating when the between-image spacing produced on said video screen by said background control signals corresponds in spacing to the contents of said between-image spacing register.

12. A video graphics display system according to claim 10 wherein each control word includes zoom parameters for producing an enlarged display of said identified graphics display data, said zoom parameters including a replication factor, said outbound FIFO controller means comprising:

a replication factor register for storing the replication factor from said control words and means for supplying each element of the graphics display data obtained from said FIFO memory to said video screen repeatedly for the number of times specified by the contents of said replication factor register.

13. A video graphics display system according to claim 12 wherein said zoom parameters also include a replication blanking factor and a replication offset factor, said outbound FIFO controller means further comprising:

a replication blanking register for storing the replication blanking factor from said control words and means for inhibiting the supply of repeated graphics display data elements to said video screen for a number of times specified by the contents of said replication blanking register, and a replication offset factor register for storing the replication offset factor from said control words and means for modifying the initial repeated supply of graphics display data elements to said video screen in accordance with the contents of said replication offset factor register.

14. A graphics display system according to claim 10 wherein each graphics display data element is represented by a certain small plurality of data bits, said one or more control words containing a parameter specifying the number of data bits per graphics image element, the video display being in color and the data bits associated with each image element establishing the produced color of the corresponding video screen pixel, said outbound FIFO controller means comprising:

a bits/pixel register for storing the parameter from said control words specifying the number of data bits per graphics image element, and color video control means for producing color video output signals to said video screen in accordance with a digital input established by a number of bits of the obtained graphics display data, said number being specified by the contents of said bits/pixel register.

15. A graphics display system according to claim 14 wherein said color video control means comprises:

a color map memory, and a color map address generator, said control word parameters also including a pixel color base address, said outbound FIFO controller further comprising:

a color base address register receiving the color base address parameter from said FIFO memory, said color map address generator combining the contents of said color base address register with the data bits representing each graphics display data element to produce a color map address, said color map address being used to access from said color map memory the corresponding color video output signals.

16. A graphics display system according to claim 10 further comprising:

a graphics control unit having:

first means for entering graphics display pixel data into said control/pixel memory, and control table assembler means for producing and entering into a control table portion of said control/pixel memory sets of control words specifying the display to be produced.

17. A video graphics display system according to claim 10 wherein said control/pixel memory means stores graphics display data representing a picture, graphics display data from a "window" portion of said picture being identified by said control words for display on said video screen, further comprising:

panning means for assembling successive sets of control word sequences for use during corresponding successive frames of said video display, each set identifying, for at least one viewport image portion of said display, graphics display data from successively different but adjacent window portions of said picture in said control/pixel memory means, the successive display on said video screen of said window portions in response to the use of said successive sets of control word sequences creating a viewport image which has the illusion of panning.

18. A video graphics display system according to claim 10 wherein said control words and said graphics display data are stored in said control/pixel memory means as multibit words, wherein said inbound FIFO controller means supplies entire control words and entire graphics display data words from said control/pixel memory means to said FIFO memory, and wherein said outbound FIFO controller means extracts from the control words stored in said FIFO memory only said display parameters and extracts from the graphics display data words stored in said FIFO memory only those portions containing graphics display data to be converted and supplied to the video screen.

19. A video graphics display system according to claim 18 wherein said extracted graphics display data need not begin at a word boundary of one of said multibit words, one of said control word display parameters specifying the beginning position of said graphics display data within said data word, said outbound FIFO controller means extracting graphics display data from the entire graphics display data word stored in the FIFO memory beginning from the position within the word specified by said one display parameter.

20. A video graphics display system according to claim 10 wherein the graphics display data defining a first portion of a viewport image to be produced on the video screen is stored in a first region of said control/-pixel memory means, and wherein the graphics display data defining a second portion of the same viewport is stored in a different region of the control/pixel memory means, two separate control words being utilized to identify respectively the graphics display data for said first and second portions of said viewport, said inbound FIFO controller means supplying to said FIFO memory, for storage at consecutive locations therein, the graphics display data for said first portion and the graphics display data for said second portion as identified by said respective separate control words, said outbound FIFO controller means obtaining from said FIFO memory as a contiguous data stream the graphics display data identified by said respective separate control words, whereby the graphics display data converted and supplied to the video screen to produce said viewport is supplied continuously and uninterruptedly to produce a seamless display.

21. A graphics display system facilitating the display on a video screen of a viewport image, comprising:

a pixel memory storing graphics image pixel data in multibit word format, the pixel data defining a first portion of the viewport image being stored in a first region of said pixel memory and the pixel data defining a second portion of the same viewport being stored in a different region of the pixel memory, a stored control table containing a set of control word sequences each consisting of at least two control words, each control word sequence specifying the parameters of a segment of said viewport image, the parameters of one control word including the pixel memory start address of pixel data for a first portion of said viewport image segment, and including an offset address within the first multibit word containing pixel data for said first portion in the event that the pixel data for said first portion does not begin on a word boundary of a multibit word in said pixel memory, the parameters of a second control word including the pixel memory start address of pixel data for the second portion of said viewport image segment, and display production means for utilizing said control word sequence to access said pixel data from portions of said pixel memory identified by said start addresses and to direct the display of said accessed pixel data onto said video screen in accordance with said parameters to produce said viewport image.

22. A graphics display system according to claim 21 in which the pixel data associated with said first portion of a viewport image ends at a boundary of a multibit word stored in said pixel memory, and wherein the pixel data defining the second portion of said viewport image begins on a word boundary of a multibit word stored in said pixel memory, said display production means utilizing the pixel data words associated with said first and second portions in a continuous and uninterrupted fashion so as to produce on said video screen a seamless viewport image.

* * * * *